United States Patent [19]

Curiel

[11] Patent Number: 4,531,611

[45] Date of Patent: Jul. 30, 1985

[54] BUILDING EVACUATION SYSTEM AND ASSOCIATED METHOD

[76] Inventor: Yoram Curiel, 1956 S. Nome, Aurora, Colo. 80014

[21] Appl. No.: 573,359

[22] Filed: Jan. 24, 1984

[51] Int. Cl.[3] ..... A62B 1/00

[52] U.S. Cl. ..... 182/44; 187/6

[58] Field of Search ..... 182/43, 44, 42; 187/6

[56] References Cited

U.S. PATENT DOCUMENTS

| | | | |
|---|---|---|---|
| 275,895 | 4/1883 | Eastman | 182/43 |
| 277,049 | 5/1883 | Mickey | 182/43 |
| 443,552 | 12/1890 | Strother | 182/44 |
| 695,775 | 3/1902 | Williams | 182/43 |
| 709,127 | 9/1902 | Wachter | 182/42 |
| 748,114 | 12/1903 | Smith | 182/43 |
| 751,870 | 2/1904 | Other | 182/44 |
| 780,795 | 1/1905 | Hansen | 182/44 |
| 783,063 | 2/1905 | Mc Clay | 182/44 |
| 916,825 | 3/1909 | Alspach | 182/44 |
| 969,209 | 9/1910 | Smith | 182/44 |
| 2,963,178 | 12/1960 | Walker | 182/42 |
| 3,348,630 | 12/1965 | Yamamoto | 182/48 |
| 3,973,644 | 8/1976 | Zephinie | 182/47 |
| 3,977,495 | 8/1976 | Zephinie | 182/48 |
| 3,994,366 | 11/1976 | Okuma et al. | 182/48 |
| 4,005,762 | 2/1977 | Zephinie | 182/48 |
| 4,122,934 | 10/1978 | Moreno | 193/32 |

FOREIGN PATENT DOCUMENTS

| | | | |
|---|---|---|---|
| 2647412 | 12/1977 | Fed. Rep. of Germany | 182/43 |
| 113 | of 1863 | United Kingdom | 182/43 |
| 9947 | of 1908 | United Kingdom . | |

*Primary Examiner*—Reinaldo P. Machado

*Attorney, Agent, or Firm*—Arnold B. Silverman

[57] ABSTRACT

A building evacuation system includes an endless conveyor member having a plurality of platform members secured thereto and upper and lower support means for supporting the endless conveyor and permitting orbital movement thereof. An elongated tubular member through which the endless conveyor passes has at least one opening in the wall generally facing the building to permit evacuees to enter the tube and get onto a platform member or emergency personnel being delivered to said building to exit from the tubular member through the opening. The platform members preferably have a rod which is rotatably secured to the endless conveyor and a platform portion disposed at or adjacent the lower end of the rod. A generator which is adapted to generate electricity responsive to movement of the conveyor may be provided. Also, a brake member which is adapted to control the orbital speed may be provided. A method of evacuation employing equipment of the above-described type.

29 Claims, 13 Drawing Figures

BUILDING EVACUATION SYSTEM AND ASSOCIATED METHOD

BACKGROUND OF THE INVENTION

1. Field of the Invention

This invention relates to apparatus and a method for the safe and rapid evacuation of a building during an emergency situation.

2. Description of the Prior Art

Fires, terrorist action and other emergency situations require prompt and safe evacuation of a building in order to save lives and minimize injuries and property loss. The problems with respect to such disasters have been more serious with respect to high-rise buildings as means for evacuation which are readily available with respect to low-rise buildings are not suitable. As is generally known, heat sensing elevators cannot be used safely in a building which is burning. In addition, stairways frequently cannot be used in times of disaster due to smoke distribution or loss of lighting as a result of disruption of electrical power. Also, it is generally understood that a fireman's ladder cannot reach higher than about eight floors. Also, there is a maximum height from which one may safely jump into a fireman's net.

Numerous documented cases exist regarding loss of hundreds for lives, in such disasters in high-rise buildings. Various means have been suggested of attempting to provide solutions to this problem. My prior application entitled "Evacuation System and Associated Method" which is copending and bears Ser. No. 568,647 provides certain suggested solutions to these problems.

British Pat. No. 9947 discloses an evacuation system wherein a rope suspended footboard is adapted to descend within a tapered chute.

U.S. Pat. No. 3,994,366 suggests an escape tube which has a cylindrical outer tube and an internal tube which is adapted to provide zig-zag path for transport of a descending individual. A zig-zag path is said to retard the speed of the falling individual.

U.S. Pat. No. 4,122,934 discloses an escape device wherein an annular, outer chamber is inflatable and has resilient portions. The falling member is said to have its rate of descent controlled by the interior of the annulus which is under gas pressure.

U.S. Pat. Nos. 3,973,644; 3,977,495 and 4,005,762 disclose an escape tube which is said to be elastic in a circumferential direction, but not in a longitudinal direction. An outer support sleeve is provided. In one embodiment a cabin is attached to a pretensioned cable to facilitate descent. The annular air chamber is said to provide a braking action. These patents also disclose the use of an endless ladder in connection with the tube restraint.

In spite of these prior disclosures, there remains a need for an improved, effective system for evacuating a building under emergency conditions in such fashion that evacuation can be accomplished safely, rapidly and in a mechanically efficient manner.

SUMMARY OF THE PRESENT INVENTION

The present invention has met the above-described need by providing an endless conveyor member to which is secured a plurality of platform members, each of which preferably consists of a rod which is pivotally secured to the conveyor member and has a support portion at or adjacent the lower extremity thereof.

Upper and lower support means which may take the form of a pulley serve to maintain tension in the endless conveyor belt and provide for an orbital path of movement thereof. Power means may be employed to effect orbital movement of the endless conveyor. At least one elongated tubular member through which the endless conveyor passes has at least one opening facing the building in order to permit evacuees to pass from the building through the tubular wall and onto a platform member.

A generator may be provided so as to generate electricity responsive to movement of the endless conveyor belt as by the influence of gravity resulting from one or more evacuees or property being on the platforms. Also, a brake member may be provided to effect control of the rate of orbital movement of the endless conveyor. The method of the present invention employs equipment of the above-described type.

It is an object of the present invention to provide a reliable, rapid and safe means for evacuating persons, animals and property from buildings.

It is a further object of the present invention to provide such means which is adapted for efficient use with high-rise buildings.

It is another object of the present invention to provide an evaculation system which minimizes undesired contact between the evacuee and a tubular member which defines a portion of the path of travel of the endless conveyor.

It is another object of the present invention to provide such a system which is adapted to be employed either in initial building construction or by means of retrofit.

These and other objects of the present invention will be more fully understood from the following description of the invention on reference to the illustrations appended hereto.

DESCRIPTION OF THE PREFERRED EMBODIMENT

While in general, it is contemplated that the present invention will be used primarily to transport people, it is understood that it may be used for people, animals or property or combinations thereof and the use of the expression "evacuee" herein shall be deemed to encompass any of these categories or combinations thereof.

Figure 1:
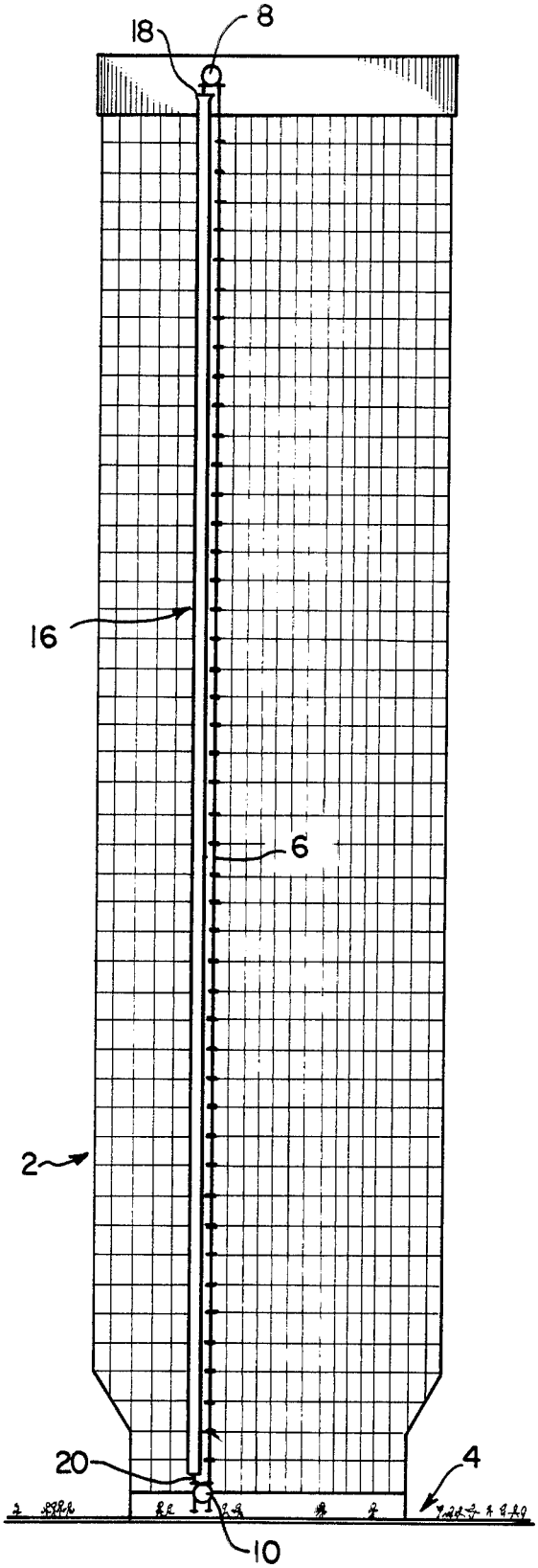
FIG. 1 is a schematic illustration of a form of building evacuation system of the present invention as secured to a high-rise building.
Figure 2:
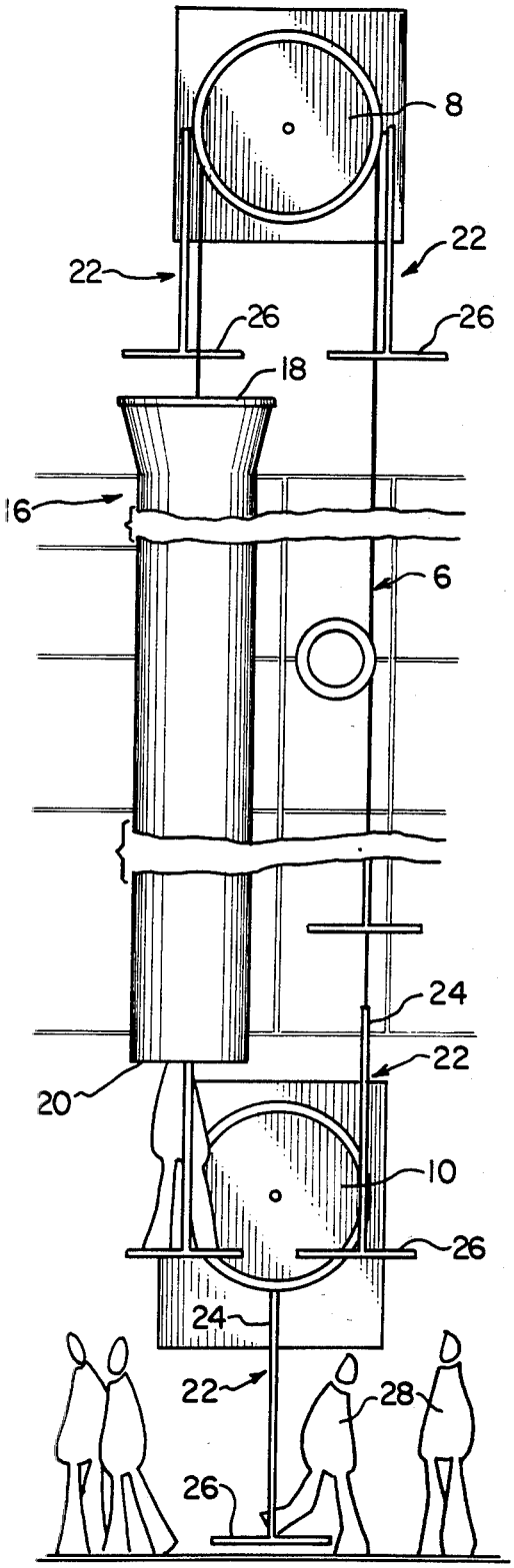
FIG. 2 is a schematic, partially broken away view of the system of FIG. 1 showing additional details.

Referring now more specifically to FIGS. 1 and 2, there is shown a high-rise building 2 which has a sidewalk level 4 and is provided with an endless conveyor 6 which is adapted to orbit in a path defined generally by upper pulley 8 and lower pulley 10. The path is illustrated as being generally parallel to an adjacent wall of said building. It is noted that one reach of the endless conveyor 6 passes through a tubular member 16 which is fixedly secured to the building, preferably in a generally vertical orientation. In the form shown, the tube has an upper end 18 disposed at a level lower than the center of upper pulley 8 and a lower end 20 disposed at a higher level than the center of lower pulley 10.

The tube 16 will have one or more openings facing the building at levels from which it will be desired to remove evacuees. These openings may conveniently be aligned with window or door-type openings in the building. As the endless conveyor orbits carrying with it its platform members, individuals may step onto the platform portion of the platform members, manually engage the other portions and be transported from the entry level to a destination level which may be either at a higher or lower level depending upon the circumstances and the direction of orbital movement of the endless conveyor 6. The orbital speed will generally be sufficient for rapid transport while being slow enough for safe transport.

Referring in greater detail to FIG. 2, there is shown the endless conveyor 6 which has a plurality of hanger members 22, each of which has an upper rod portion 22 which is preferably pivotally secured to the endless conveyor 6 and a lower platform portion 26 on which evacuees are to stand. As the endless conveyor moves through its orbital path in either direction, the platform members 22 will preferably be maintained throughout their orbit with the rod in the upper position and the platform 26 in the lower position. As the upper portion of tubular member 16 diverges, when the endless belt is moving in a counterclockwise direction as shown in FIG. 2, the flared surfaces of the upper tube portion will serve to direct the platform 26 into the tube 16. In systems where it is likely that the endless belt may be orbited in a clockwise direction for evacuation through an upper level, a flared bottom of the portion of the tube may be provided at 20. It will be appreciated that the tube 16 not only serves to shield the evacuees from flames and heat of the fire, but also minimizes the risk of an accidental fall. It is preferred that the extent of the tube be at least 80% of the distance between the centers of the upper and lower pulleys. Also, if desired, two tubes may be provided with each of the long reaches of the endless conveyor passing through one of them and the tubes being generally parallel to each other. In instances where two such tubes are used, both may be provided with openings facing the building, if desired.

The tubes are preferably made from fireproof, durable materials such as metal, plastics, composites and the like, for example.

Figure 3:
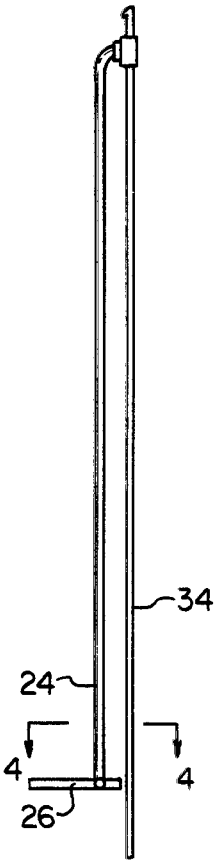
FIG. 3 is a partially schematic elevational view showing a portion of the endless conveyor and an associated platform member.
Figure 4:
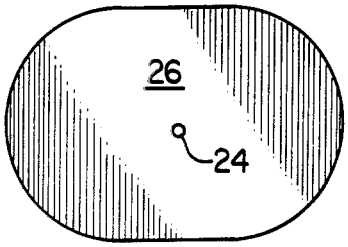
FIG. 4 is a cross-sectional illustration of the platform member of FIG. 3 taken through 4—4.

Referring more specifically to FIGS. 3 and 4, it will be appreciated that the platform members have their upper portions secured to the cable 34 of conveyor 6. It is preferred that the spacing between adjacent platform 26 be at least about six-and-one-half feet in order to accommodate adult evacuees in an erect position. In general, the feet of the evacuee would be supported on platform 26 and the hands would be in manual engagement with a portion of rod 24. If desired, a safety belt or other harness (not shown) may be wrapped around the individual's waist or upper body and secured to the rod 24. It is noted, as is shown in FIG. 4, that the platform 26, in the form shown, is of generally rectangular shape with curved ends, although a wide variety of other shapes may be employed.

Figure 5:
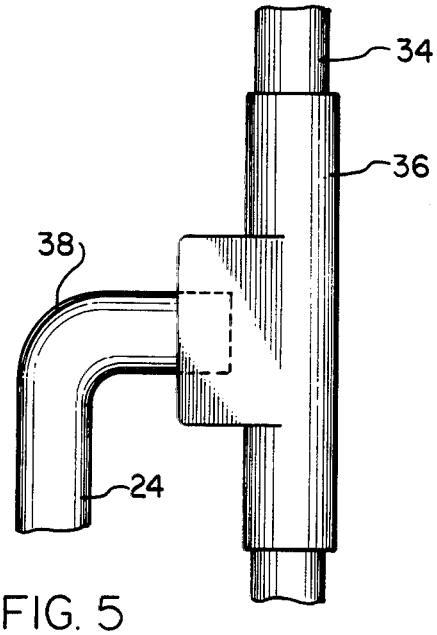
FIG. 5 is a detailed illustration of a portion of the cable and the connecting means which secure a platform member thereto.
Figure 6:
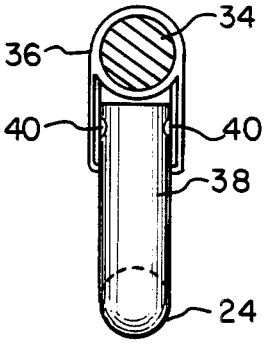
FIG. 6 is a cross-sectional illustration of a portion of the platform member-cable connection.

Referring to FIGS. 5 and 6 there is shown the connecting means which secure the rods 24 to the cable 34. A clamp 36 is fixedly secured to the cable 34 as by welding or mechanical fasteners or other suitable means. By means of a bridging member 38 the rod 24 is axially displaced from the cable in order to simplify the orbital movement of the endless conveyors with the platform members secured thereto. Bearing member 40 provides a rotatable connection between the formed upper portion of rod 24 and the cable. Axial rotation of portion 38 of rod 24 serves to permit the desired generally vertical orientation of the rod 24. As a result, as the cable passes around one of the pulleys 8, 10, the platform members remain in generally vertical orientation.

Figure 7:
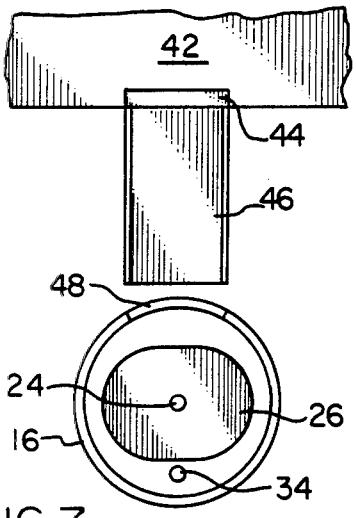
FIG. 7 is a fragmentary plan view showing a portion of the tubular member with its opening and a walkway connecting a building opening with the same.

As is shown in FIG. 7, the building 42 to be evacuated has an opening such as a window, for example at 44. A permanently installed bridge or walkway 46 is generally horizontally oriented and projects outwardly from the building to which it is secured. The tubular member 16, which in the form shown is generally circular, has an opening 48 which is aligned with the walkway 46. An individual emerging from the opening 44 may move along the walkway 46 and pass through the opening 48 to step onto platform 26 and manually engage the rod 24. The orbiting belt may be moved at a sufficiently slow rate that an individual may safely step onto the platform 26, or in the alternative, the belt's motion may be stopped periodically to permit evacuees to enter and be discharged from the platforms 26.

Figure 8:
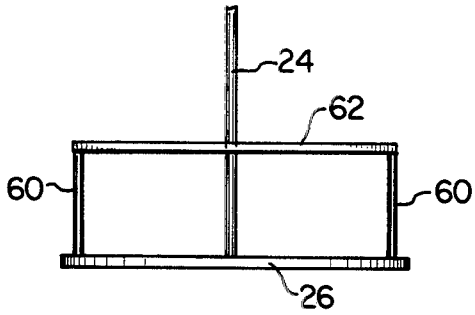
FIG. 8 is an illustration of a modified platform member having a railing around the platform portion.
Figure 9:
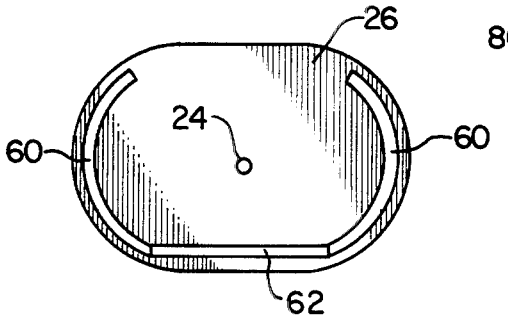
FIG. 9 is a top plan view of the modified platform of FIG. 8.

Referring to FIGS. 8 and 9, there is shown a modification wherein an upwardly projecting railing consisting of post members 60 and a horizontal rail 62 are secured to the platform 26 as an additional security measure to resist injury to the evacuees.

Figure 10:
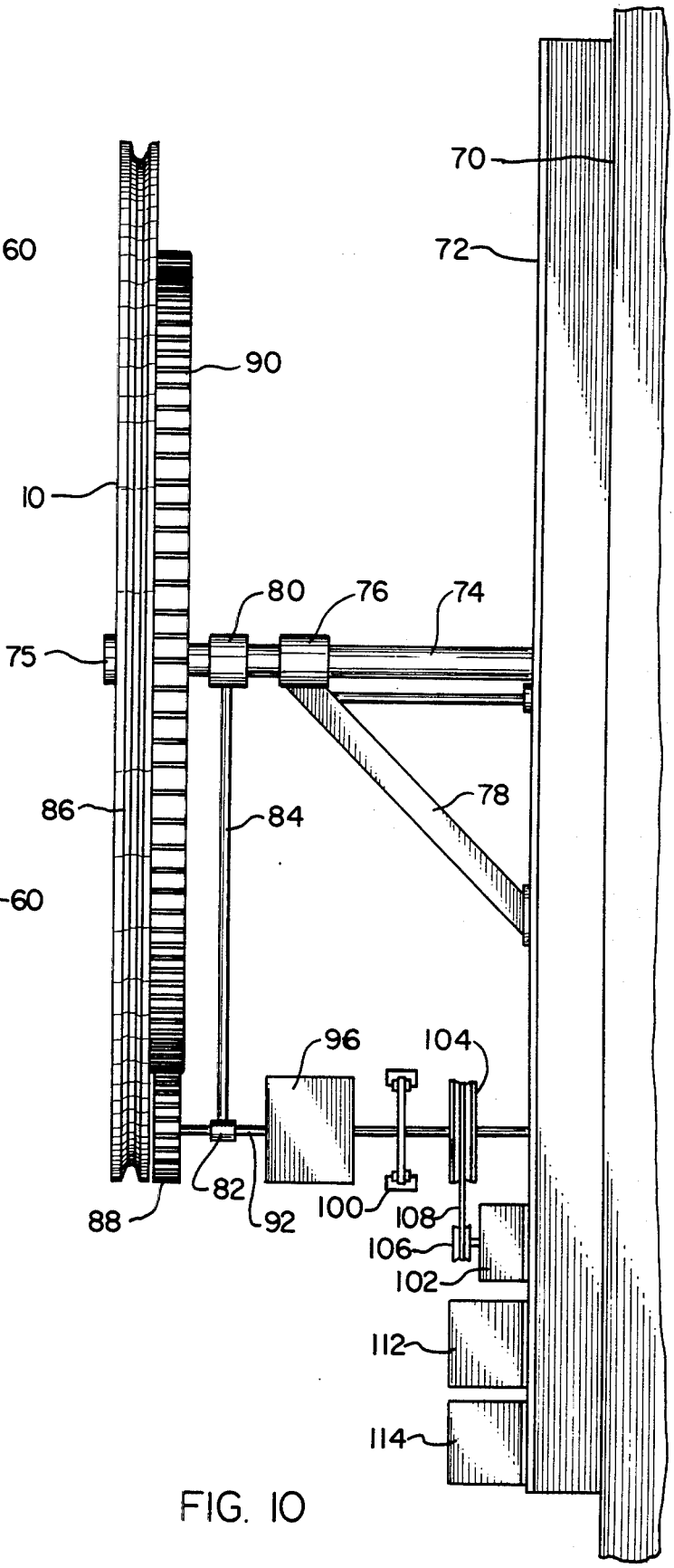
FIG. 10 is an elevational view showing a portion of one of the support means and associated apparatus.

FIG. 10 illustrates a form of pulley assembly and associated apparatus which may be employed in the present invention. It is generally preferred that this particular pulley unit be employed as the lower pulley 10 and that the upper pulley 8 may function as an idler unit. The building face 70 has a mounting frame 72 secured thereto. Main shaft 74 is journaled in bearing 76 (which is supported by strut member 78) and bearing 80 and passes through gear 90 and pulley 10. A shaft cap 75 is provided. Gear 90 is preferably fixedly secured to pulley 10 and rotatable with respect to shaft 74. Gear 88 meshes with gear 90 and is fixedly secured to shaft 92 which is journaled in bearing 82. Rod 84 connects and supports bearings 80, 84. The inner end of shaft 92 is suitably journaled in the mounting frame 72, as is main shaft 74. In normal usage, an electric motor or internal combustion engine 102 will serve to drive pulley 106 which is connected to pulley 104 by means of belt 108 thereby rotating shaft 92 and gear 88 to effect rotational movement of pulley 10 which has cable 34 disposed within groove 86. Brake member 100 is set so as to maintain the desired orbital velocity of the endless conveyor 6. Control unit 112 is provided at a conveniently accessible location. In the event of a power failure associated with a disaster, it will be appreciated that individuals may be removed downwardly by allowing the influence of gravity to cause them to travel under the influence of their own weight, subject to whatever desired braking action might be effected through brake 100. If desired, the brake 100 may be controlled in remote manner, as by a radio signal or an extension wire through a solenoid, for example. Under the influence of such movement, alternator or generator 96 will create electricity which in turn may be used to energize the motor 102. As a further alternate, a battery unit 114, which may consist of one or more batteries, may be employed to energize the motor 102 or control the brake 100.

Figure 11:
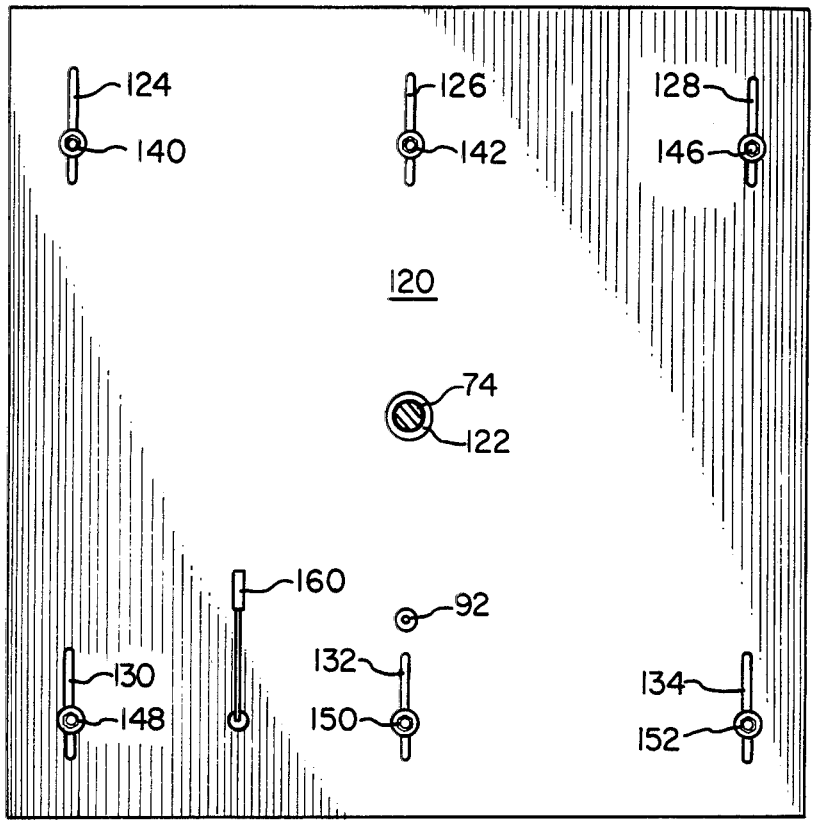
FIG. 11 is an illustration of a mounting plate for either the upper or lower supporting member.
Figure 12:
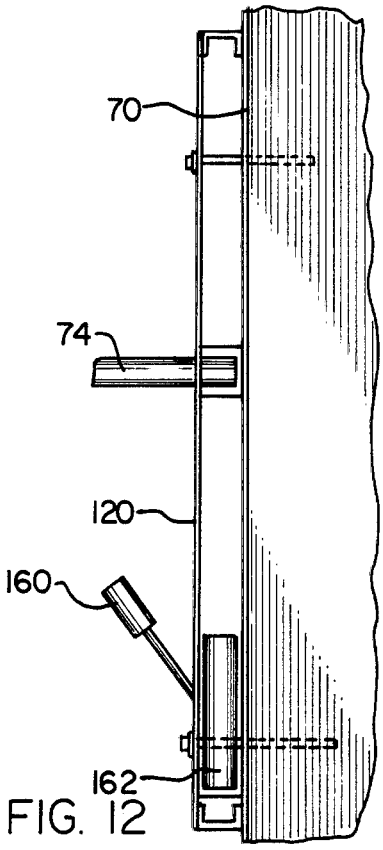
FIG. 12 is a side-elevational view of the mounting plate and associated hydraulic unit.
Figure 13:
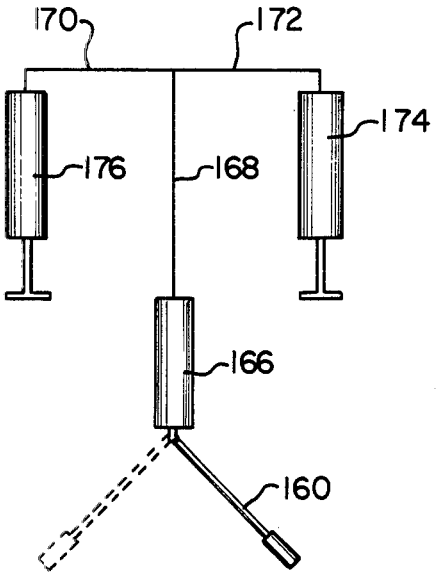
FIG. 13 is a schematic illustration of the hydraulic unit.

FIG. 11 shows a form of mounting plate 120 suitable for use in mounting either of pulleys 8, 10. In order to maintain the desired tension in the endless conveyor, it may be desirable to move one or the other of the mounting plates so as to adjust the tension in the endless conveyor 6 accordingly. The plate 120 shown in FIG. 11 has a plurality of elongated slots 124–134 which are generally vertically oriented and associated bolts 140–152 which permit a degree of adjustment vertically of the pulley position corresponding to the desired change in conveyor tension. One of the advantageous means which may be employed to effect this movement of the plate is a hydraulic unit 162 (FIG. 12) which may advantageously be positioned behind the plate 120 with an operating handle 160 projecting therethrough. A pair of hydraulic cylinders 174, 176 are adapted to be supplied with pressurized fluid from pump 166 when the handle 160 is moved to the desired position thereby permitting fluid to flow through lines 168, 170, 172 to the two hydraulic cylinders thereby effecting responsive movement of the piston rods which are secured to mounting plate 12.

It will be appreciated, therefore, that the present invention provides an effective, safe, rapid and economical means for evacuation of buildings, including high-rise buildings, under emergency conditions. In addition, it provides a uniquely constructed means of effecting evacuation from various levels of the building through one or more fixed protected tubular members in order that movement either to a higher or lower level of the building may be provided from any of the predetermined evacuation levels within the building. The apparatus is of simple construction and is adapted to be powered by a suitable motor or engine unit with appropriate backup means and speed control means. The evacuees are sheltered from undesired exposure to flames, heat, debris or other potentially dangerous conditions during travel. If desired, a cover member may be placed in spaced relationship over the tubular members to resist entry of debris into the tube while not interfering with conveyor operation.

While for purposes of simplicity of illustration a system having a singular tubular member has been illustrated, it will be appreciated that a system having two such tubular members is preferred with each of the tubes extending at least eighty percent of the distance between the center of the pulley members. This permits greater flexibility in terms of direction of movement during evacuation and position from which evacuation will be effected. Also, it permits simultaneous evacuation of people from the building while rescue people are moving into the building.

While for purposes of convenience of illustration herein the endless conveyor has been shown as being composed of a cable, it will be appreciated that it may be composed of other endless members such as a belt, for example.

While the preferred use of the present invention is intended to be in connection with evacuation of buildings in time of disaster, it may be employed in connection with the movement of evacuees other than out of a building, it may also be used to bring firefighters, medical personnel, police and others into portions of a building where they are needed. Such additional uses are expressly contemplated and shall be deemed to be embraced by the reference to "building evacuation system", "building evacuation method" and similar terms herein.

The tube or tubes may be secured to the building by any suitable means such as suitable rigid metal members which are secured to the tube, as by mechanical fasteners, for example, and are anchored to the building.

Whereas particular embodiments of the invention have been described above for purposes of illustration, it will be appreciated by those skilled in the art that numerous variations of the details may be made without departing from the invention as described in the appended claims.

I claim:

1. A building evacuation or entry system comprising an endless conveyor member, a plurality of platform members secured to said conveyor member, upper and lower support means for supporting said endless conveyor member and permitting orbital movement thereof in a path generally parallel to an adjacent wall of said building, at least one elongated tubular member through which said endless conveyor passes, and at least one opening in the wall of said tubular member generally facing said building to permit evacuee entry into said tube and onto a said platform member or evacuee exit thereform, whereby an individual or property may be raised or lowered by said orbiting endless conveyor member.

2. The building evacuation system of claim 1 including said elongated tubular member being generally vertically oriented and having an upper end disposed below said upper support means and a lower end disposed above said lower support means.

3. The building evacuation system of claim 2 including two said tubular members oriented generally parallel with respect to each other being provided.

4. The building evacuation system of claim 1 including means for maintaining tension in said conveyor member.

5. The building evacuation system of claim 3 including said elongated tubular members having an internal dimension which is substantially larger than said platforms in order to minimize contact between said evacuee and said tubular member.

6. The building evacuation system of claim 1 including said platform members having an elongated rod member and a platform disposed at or adjacent the lower end of said rod member.

7. The building evacuation system of claim 4 including said platform members being pivotally secured to said endless conveyor.

8. The building evacuation system of claim 4 including power means for effecting orbital movement of said endless conveyor.

9. The building evacuation system of claim 5 including said platforms having railing means extending upwardly therefrom.

10. The building evacuation system of claim 5 including the spacing between adjacent platforms being greater than about six-and-one-half feet.

11. The building evacuation system of claim 7 including said platform members having bracket means fixedly secured to said endless conveyor, and bearing means permitting free rotation of said platform with respect to said endless conveyor.

12. The building evacuation system of claim 8 including said power means having motor means for effecting rotation of at least one of said upper and lower support means.

13. The building evacuation system of claim 8 including said power means having auxiliary power means.

14. The building evacuation system of claim 6 including brake means for controlling the rate of orbital movement of said endless conveyor.

15. The building evacuation system of claim 12 including said upper and lower support means each including pulley means.

16. The building evacuation system of claim 15 including generating means for generating electricity responsive to rotation of at least one of said upper and lower support means.

17. The building evacuation system of claim 6 including said endless conveyor being a cable.

18. The building evacuation system of claim 6 including said endless conveyor being a belt member.

19. The building evacuation system of claim 13 including said auxiliary power means having a battery.

20. The building evacuation system of claim 13 including said auxiliary power means having an internal combustion engine.

21. The building evacuation system of claim 5 including said elongated tubular members being substantially rigid.

22. The building evacuation system of claim 5 including said tubular member having an enlarged upper end to facilitate entry of said platforms into said tubular member.

23. The building evacuation system of claim 3 including said second tubular member through which a second reach of said endless conveyor passes having a plurality of said openings.

24. The building evacuation system of claim 4 including said tension-maintaining means having means for adjusting the relative spacing between said upper and lower support means.

25. The building evacuation system of claim 24 including said tension-maintaining means having spring biased means contacting said endless conveyor.

26. The building evacuation system of claim 21 including walkway means connecting said building with at least one of said tubular members.

27. A method of evacuating a person or property from or introducing a person into a building comprising providing an endless conveyor member having a plurality of platform members secured thereto and an elongated tubular member through which said conveyor passes with at least one opening in said tubular member facing said building, orbiting said endless conveyor through said tubular member, in an orbital path which is generally parallel to an adjacent wall of said building, introducing a person or property onto a said platform member through said tube opening at a first level, discharging said person or property at a destination level, and during transport of said person or property, minimizing contact between said tube and said person or property, whereby said person or property may be raised or lowered by said orbiting conveyor.

28. The method of evacuation of claim 27 including providing said platform member with an elongated rod and a platform, and said person during said travel manually engaging said rod portion while being supported on said platform.

29. The method of evacuation of claim 27 including substantially completely resisting contact between said person or property and said tube during said travel.

* * * * *